United States Patent [19]

Gilkeson et al.

[11] 4,262,736

[45] Apr. 21, 1981

[54] APPARATUS FOR HEAT PUMP MALFUNCTION DETECTION

[76] Inventors: Robert F. Gilkeson, 1084 Broadview Rd., Wayne, Pa. 19087; George C. Wiedersum, 710 Crum Creek Rd., Broomall, Pa. 19008

[21] Appl. No.: 86,167

[22] Filed: Oct. 18, 1979

[51] Int. Cl.[3] ..... F28F 27/00

[52] U.S. Cl. ..... 165/11 R; 165/29; 236/94

[58] Field of Search ..... 165/11, 29; 62/125, 62/127, 130, 126; 236/94; 73/112, 339 C

[56] References Cited

U.S. PATENT DOCUMENTS

| | | | |
|---|---|---|---|
| 3,707,851 | 1/1973 | McAshan | 62/125 |
| 3,743,009 | 7/1973 | Dagerford | 165/11 |
| 4,217,761 | 8/1980 | Cornaire et al. | 62/130 |

*Primary Examiner*—Albert W. Davis
*Assistant Examiner*—Margaret A. Focarino
*Attorney, Agent, or Firm*—Paul & Paul

[57] ABSTRACT

A malfunction detection apparatus is provided for a heat pump system incorporating auxiliary resistance heaters, for detecting when the heat pump has lost efficiency, due to less than a catastrophic failure, and is therefore energizing the resistance heaters when they would not normally be energized, whereby a signal may be provided, such as a warning light, for announcing when the resistance heater has been energized while the outside temperature is above the system balance point.

9 Claims, 4 Drawing Figures

APPARATUS FOR HEAT PUMP MALFUNCTION DETECTION

BACKGROUND OF THE INVENTION

This invention is directed to an improved fault monitoring circuit for a reverse cycle air-conditioner, commonly referred to as a heat pump. More specifically, this invention is directed toward a fault detection circuit for a heat pump system which incorporates auxiliary resistance heaters for providing additional heat when the outside temperature is below the "balance point" of the heat pump system. Such circuitry is to be utilized for detecting a loss of efficiency in the heat pump system whereby the resistance heaters are prematurely activated.

An electrically operated heat pump provides the means for reducing the amount of energy utilized in heating a building. The electric energy that operates the heat pump provides only part of the heat output, the remainder is obtained from an external source such as air or water. The ratio of the heat output to electrical input (in equivalent units) is the co-efficient of performance (COP) of the heat pump and can be equal to 2 or higher. With recent increases in the cost of other sources of heat, the heat pump has become a competitive heating system.

However, an inherent characteristic of the heat pump when operated as a heat source is that as the outside air temperature goes down, the heat output from the heat pump system is reduced. There is an outdoor temperature at which the heat pump is unable to supply the heating requirements for the building it is servicing, this is known as the "balance point".

In order that indoor temperatures will not reach uncomfortable levels when the outdoor temperature is below the balance point, electrical resistance heaters are commonly provided within the heat pump system to supplement heat pump output. However, such heaters have a COP of only 1, and thus are much more expensive to operate than the heat pump. It is desirable therefore that the resistance heater operation is kept to a minimum.

Several stages of resistance heat are typically provided in heat pump systems, which stages are energized sequentially to prevent large surges of load current on the electrical system and to avoid using more such heat than absolutely necessary. The first stage of such resistance heating is typically energized from an indoor thermostat, when the indoor temperature falls about 2° below the thermostat set point, indicating that the heat pump is unable to supply sufficient heat to maintain the desired indoor temperature. Subsequent stages of resistance heating are controlled by varying methods, outdoor thermostats and time delays being among them.

For a heat pump that is operating as designed, the resistance heaters should not be energized as long as the outdoor temperature is above the balance point. It is possible, however, for the heat pump to lose part of its heating capacity through a malfunction such as a minor refrigerant leak, so that it is not operating at peak efficiency and cannot supply sufficient heat at the balance point or possibly some degrees above it. If this occurs, the resistance heaters will be energized by the indoor thermostat. The building occupant more than likely will not be aware that this is happening, as a comfortable indoor temperature is being maintained. He will become aware, later, when he receives his electric bill, such bill normally covering a month or more of such operation, because the resistance heat will have consumed much more electricity.

It is desirable to provide a device which will alert the building occupant to the existence of a loss of system efficiency and premature activation of resistance heaters in the heat pump so that he may provide corrective maintenance promptly and therefore minimize electrical power consumption. No such system degradation device is currently in the marketplace.

An object of this invention is to provide a heat pump system with a balance point thermostat, said thermostat being set at the empirical, or alternatively, the mathematically calculated, balance point outdoor temperature for a heat pump system.

A second object of this invention is to provide a monitoring circuit for detecting when the heat pump is in the heating mode, and the auxiliary resistance heater has been prematurely activated.

A further object of this invention is to provide a detectable signal, announcing that the auxiliary heaters of the heat pump system have been prematurely activated indicating loss in efficiency of the system.

An even further object of this invention is to provide this monitoring circuit for electrically determining when the heat pump system is in the heating mode, the outdoor temperature is above the balance point threshold temperature, and the resistance heater is activated, to provide an alarm signal indicating loss of efficiency.

SUMMARY OF THE INVENTION

The objects of this invention are realized in a malfunction detection, fault monitoring circuit for a heat pump system which includes auxiliary resistance heaters as an integral part thereof. This circuit alarms or signals system degradation, i.e., loss in efficiency resulting in premature resistance heater operation in the heating mode. This malfunction detection circuit may be connected to monitor the operating state of the various components of the heat pump system.

Heat pump systems indoor thermostats are typically able to keep the indoor temperatures within 2° of the set point as long as the outdoor temperature does not fall below the balance point temperature; below the balance point temperature the electrical resistance heaters are activated.

The circuit of the subject invention monitors the outdoor balance point thermostat to determine when that temperature is above the set point. It monitors the heat pump reversing valve to determine if the system is in the heating mode and it monitors the status of the auxiliary resistance heater. By monitoring these functions the circuit is also able to determine when the heat pump is in the defrost mode, i.e., when the reversing valve directs the unit into a cooling mode in which it takes heat out of the building to melt ice accumulation on the outdoor heat exchanger while operating the auxiliary resistance heater to maintain building temperature.

A warning light may be activated when the first stage heater relay calls for heat prematurely, i.e., when outdoor temperature is above the balance point. This warning light may be locked on once activated so that it need be monitored only periodically to determine a degradation or loss of efficiency of the heat pump system.

DESCRIPTION OF THE DRAWINGS

The detailed inventive features, advantages and operation of the invention will be easily understood from a reading of the following detailed description of the invention in conjunction with the accompanying drawings in which like numerals refer to like elements and in which.

DETAILED DESCRIPTION OF THE INVENTION

Figure 1:
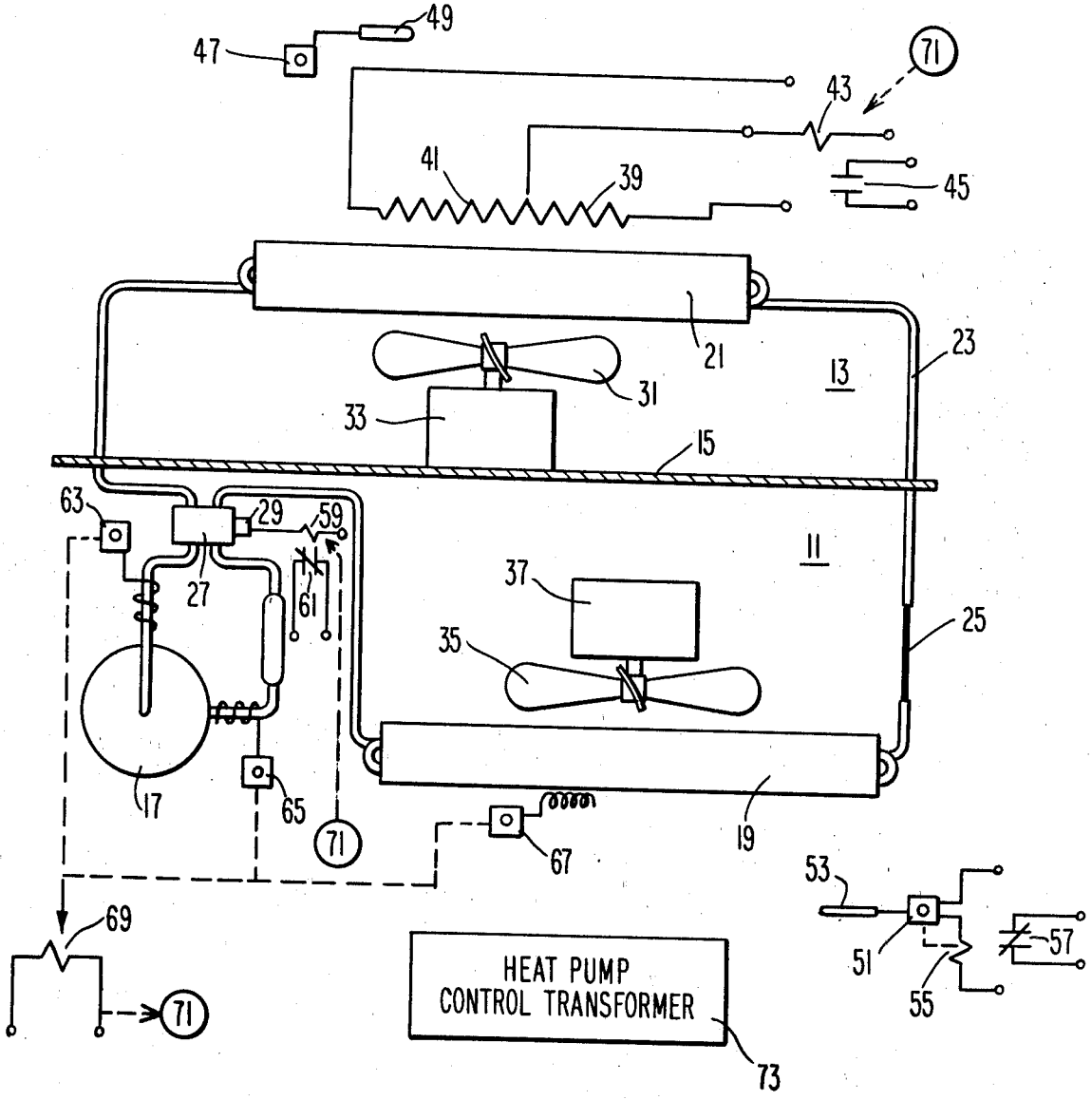
FIG. 1 is a block diagram of a heat pump air conditioning system embodying this invention.

A reversible air conditioning, refrigeration heating system or heat pump can be used to heat or cool a building. Such heat pump systems, including the operation controls therefor, have been disclosed by Fedelman, U.S. Pat. No. 3,537,509 and W. J. McCarty, U.S. Pat. No. 4,024,722. The present invention provides an improvement to those systems. A heat pump, FIG. 1, has an outdoor portion 11 and indoor portion 13 separated by a wall or partition 15. A compressor 17 is connected to an indoor heat exchanger 21 and an outdoor heat exchanger 19 via refrigerant piping 23. Included in this refrigerant piping is a capillary tube 25 which forms a suitable flow restriction means for connecting the outdoor and indoor heat exchangers, 19, 21. The compressor 17 is connected to the heat exchangers 19, 21 through a reversing valve 27 which is solenoid 29 driven. This solenoid 29 and reversing valve 27 are in one position during a heating mode and in the other position during a cooling or defrosting mode.

A fan 31 driven by a motor 33 is provided for circulating air over and through the indoor heat exchanger 21. A second fan 35 is driven by a second motor 37 circulates air over and through the outdoor heat exchanger 19.

An auxiliary heater having a first stage 39 and additional stages 41 is provided in the indoor section in the path of air flowing through the indoor heat exchanger 21 for the purpose of supplying heat to the indoor air stream under certain operating conditions. Typically, this heater 39, 41 is an electrical resistance type heater. The first stage heater 39 includes a relay 43 which is connected to operate a normally open switch 45.

An adjustable indoor thermostat 47 includes a temperature sensing element 49 and is used to control the operating status of the heat pump (cooling or heating) and to set the automatic temperature conditions therefor. This thermostat 47 is of a conventional type and is connected to the heat pump components in a conventional manner.

A second adjustable thermostat 51 includes a second temperature sensing element 53. This second thermostat 51 and sensor element 53 are positioned on the outside of the building. This outdoor thermostat 51 is of a conventional type which can be set at the system balance point temperature which usually is in the range of 20° F. to 40° F. This outdoor thermostat includes a relay switch 55 which is connected to operate a normally closed switch 57.

The solenoid 29 is electrically serially connected to a relay 59 for operating a normally open switch 61.

A typical heat pump system includes the sensors 63, 65 and 67 each having associated therewith a capillary sensing tube, for sensing frosting conditions in the refrigerant piping 23 directly adjacent to the compressor 17 and in the outdoor heat exchanger 19. These sensors 63, 65 and 67 are connected in parallel to operate a fourth relay 69 for operating a control line 71 to put the heat pump into the defrosting mode. This control line 71 is connected to activate the reversing valve relay 59, to put the heat pump into the cooling mode and thereby using building heat to defrost the outdoor components, while concurrently activating the resistance heater relay 43. For heat pumps of some manufacture, relay 59 is energized to accomplish this, while for others, it is deenergized. The electrical elements described above are in circuit with, and electrically connected as part of, the control circuitry 73 for the heat pump system which also includes a low-voltage transformer.

Figure 2:
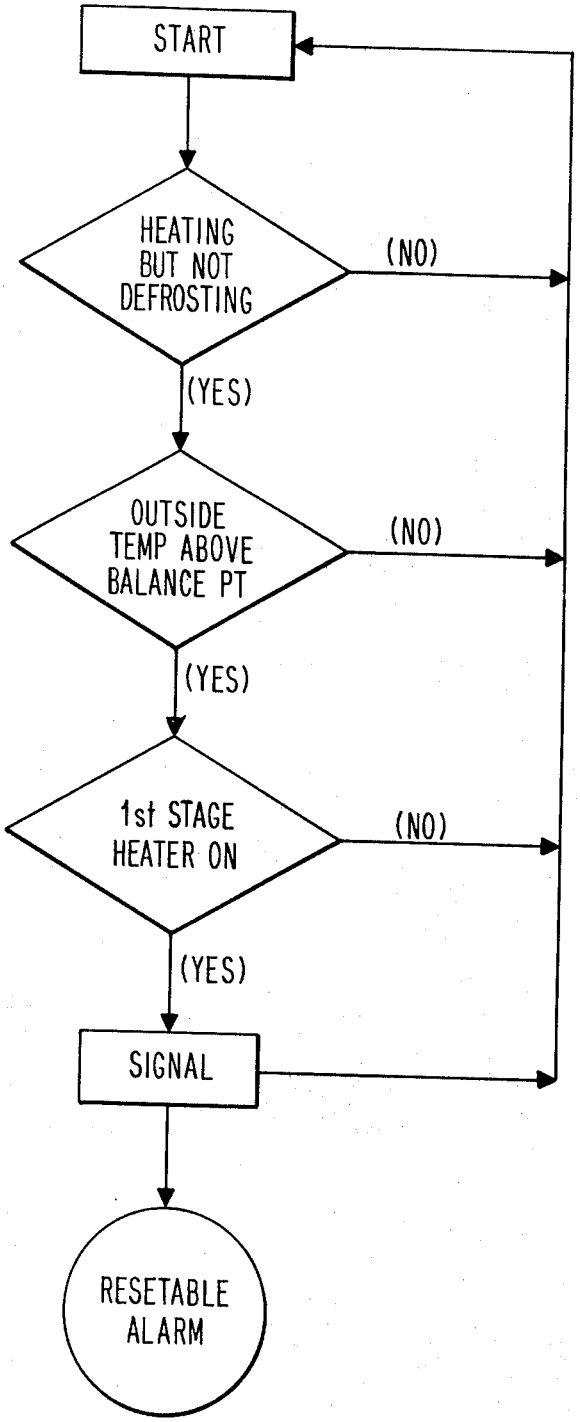
FIG. 2 shows a logic diagram for the operation of the heat pump malfunction detection circuitry of this invention.

In monitoring and alarming the malfunction operation of the degraded heat pump, the circuitry described above in connection with FIG. 1 operates according to the algorithm shown in FIG. 2. Within the heat pump system the operation is constantly being monitored, FIG. 2, to detect whether the system is in the heating mode but not the defrosting mode, whether the outdoor temperature is above the system balance point (balance point being that outdoor temperature below which the properly efficient heat pump can no longer supply the heat loss to the building to which it is connected), and whether the first stage electrical resistance heater is operating. If the unit is not defrosting and the outdoor temperature is above the balance point and the first stage heater is on, the circuitry will activate a manually resettable alarm, including energizing a light, to indicate that the unit is operating at less then desired efficiency, i.e., there is a degradable malfunction, and the first stage heater is operating when it should not be, e.g. a fault has been detected.

Figure 3:
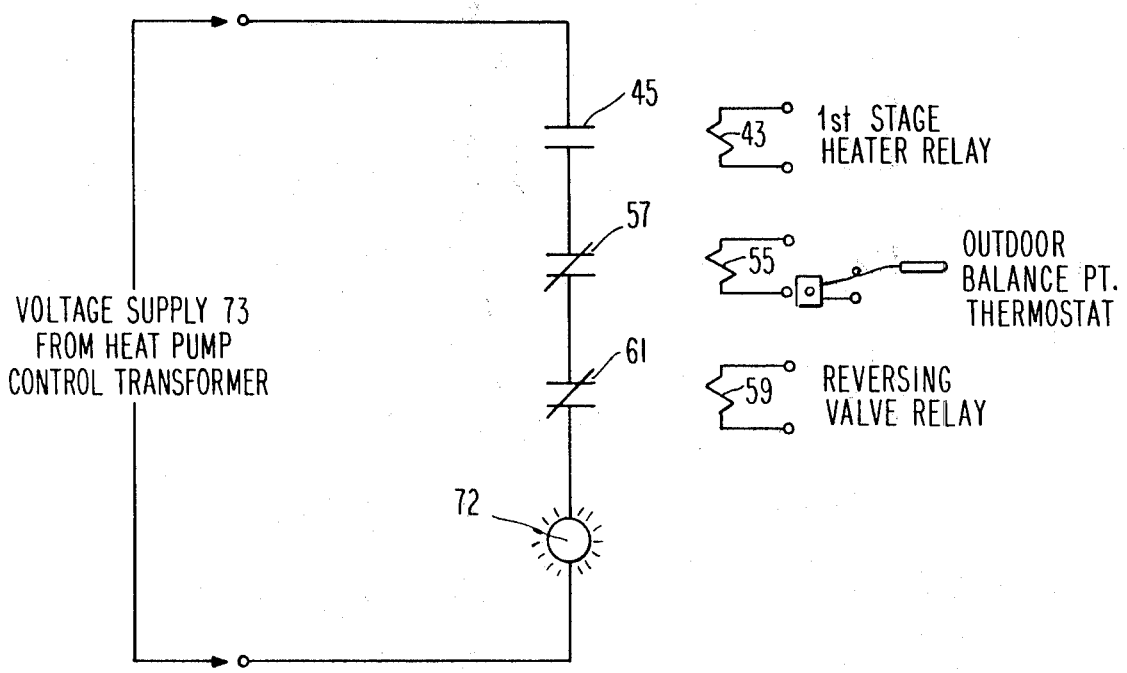
FIG. 3 is a block diagram for the heat pump malfunction detection circuitry which monitors the operation of the heat pump and signals an alarm when the fault is detected.

The monitoring and detection circuitry FIG. 3, includes a first normally open switch 45 operated off of the first stage heater relay 43. This switch 45 is connected in series to the second normally closed switch 57 driven by the outdoor balance point thermostat relay 55. Also in series is a third normally closed switch 61 which is operated by the reversing valve relay 59. (For some heat pump manufacturers, this switch 61 is normally open). A signal light 72 is also in the series connection. The series connection of the switches 45, 57, 61 and the light 72 is connected across low voltage A.C. supplied from the heat pump control transformer 73.

The circuit, FIG. 3, operates to detect a malfunction in the heat pump apparatus which is caused by a degradation in the heat pump performance, typically due to refrigerant loss, whereby the heat pump system is unable to supply the heat called for when the outdoor temperature is above the balance point causing permature activation of the first stage heater relay 43. Under such fault conditions the first stage heater relay 43 will have operated to close the switch 45 but the outdoor balance point thermometer would not have operated its relay 55 to open the switch 57 and the reversing valve relay 59 would be in a status to allow the switch 61 to remain closed. With the series switches 45, 57, and 61 closed the lamp 72 is activated to signal a malfunction or fault.

Figure 4:
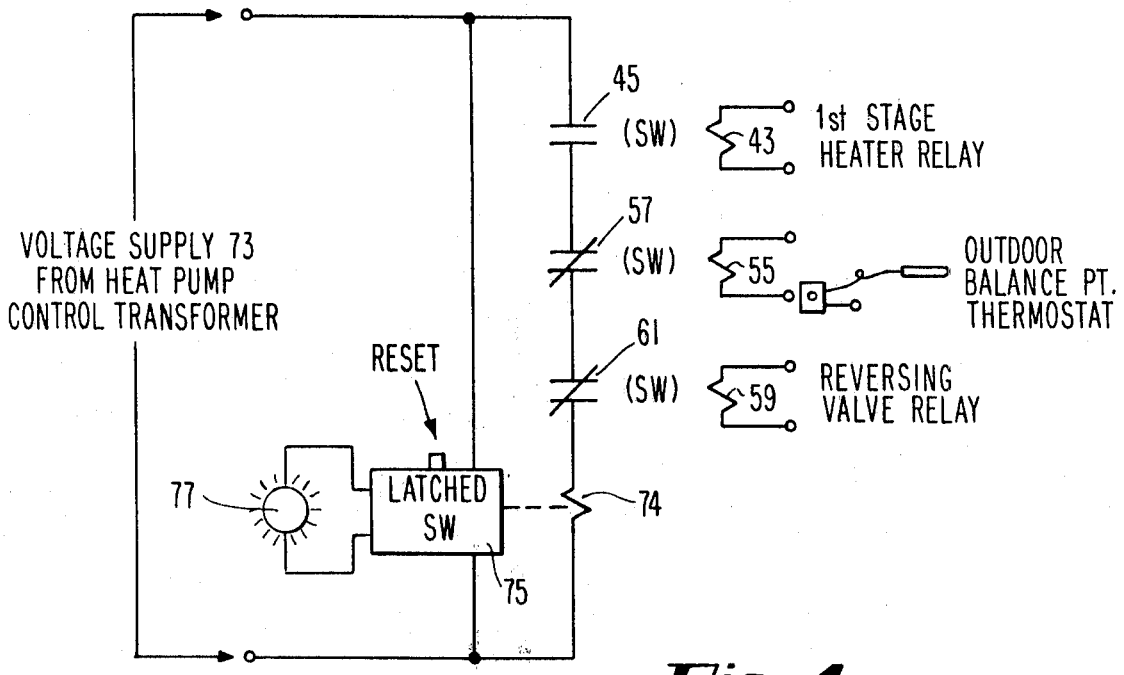
FIG. 4 is a modification of FIG. 3, showing a latched switch which provides a continuous indication of a fault that may not have been observed at the time of occurrence.

An alternate embodiment to the circuit of FIG. 3 is shown as FIG. 4. Here a relay 74 is connected in series with the switches 45, 57 and 61 instead of the lamp 72. When activated this relay 74 operates a latched switch 75 which is connected across the voltage supply from the heat pump transformer.

The latched switch 75 can be any of a number of commercially available switches - which are electrically activated "on" and which remain on thereafter until manually reset. This latched switch 75 operates to power an alarm or signal light 77 connected thereto. With this circuit, FIG. 4, if the first stage heater relay 43 has been prematurely activated due to a degradation in the system during the night when the signal light 72, FIG. 3, would not normally be observed, or during any absence from the building of monitoring personnel, the light 77, FIG. 4, will remain on, alerting individuals at a later time that during their absence a malfunction had occurred. Of course, once a fault occurs and if it continues to occur the light 77 would continue to burn even if the switch 75 is reset.

In this manner the building owner could easily determine that his system had degraded long before he received his monthly or bi-monthly electrical bill. Prompt attention to the operating condition of the heat pump system would be affected greatly saving excessive energy consumption by the electrical resistance heater 39.

Many changes can be made in the above-described malfunction detection circuit without departing from the intent and scope thereof. The logic need not be implemented by serially connected circuitry as shown in the principal embodiment, nor would the circuitry need to be implemented in the exact manner is illustrated. Digital logic circuitry could be used as well as other types of components.

While the latched switch 75 provides a time delayed inspection of the malfunction detection alarm signal, light 77, this feature need not be included. An alternate alarming device could be placed directly into the circuit and could yield a "real time" or delayed alarm signal function. Alternately, a recording device could be connected into the circuit which would provide a permanent record of a "fault connection". It is intended, therefore, that all matter contained in the above description and shown in the accompanying drawings is to be interpreted as illustrative and is not to be taken in the limiting sense.

What is claimed:

1. A malfunction detector circuit for a heat pump system having operation circuitry including a low-voltage transformer, a reversing valve for establishing heating and cooling modes, and having an auxiliary resistance heater as an integral part thereof, said circuit detecting a degradation in said heat pump performance resulting in premature resistance heater operation, comprising:

means for establishing an outdoor temperature threshold above which said resistance heater operation should not be needed; and means for providing an alarm signal when said outdoor temperature is above said threshold, said heat pump is in the heating mode and said auxiliary resistance heater is operating, said alarm signal means being connected to said outdoor temperature threshold means and said operation circuitry.

2. The circuit of claim 1 wherein said alarm signal means includes:

means for including when said resistance heater is in operation said resistance heater indicating means being electrically coupled with said resistance heater;

means for indicating when said reversing valve position has said heat pump in said heating mode said heating mode indicating means being electrically associated with said reversing valve; and means for providing a signal, said signal providing means being responsive to said outdoor temperature threshold means, said resistance heater indicating means and said heating mode indicating means.

3. The circuit of claim 2 wherein said signal providing means activates a signal when said outdoor temperature is above said threshold, said resistance heater is activated and said heat pump is in said heating mode.

4. The circuit of claim 2 wherein said outdoor temperature threshold means includes an outdoor thermostat with associated temperature sensing element, said outdoor thermostat having in circuit therewith including a first relay said first relay operating to control the position of a first switch.

5. The circuit of claim 4 wherein said resistance heater indicating means includes a second relay connected in circuit with said resistance heater and a second switch whose position is determined by the operating state of said second relay.

6. The circuit of claim 5 wherein said heating mode indicating means includes a third relay electrically coupled to said reversing valve, said relay activation/deactivation being directly coupled with the state of said reversing valve, and a third switch whose position is determined by the operating state of said third relay.

7. The circuit of claim 6 wherein said first, second and third switches are connected in series across said low-voltage transformer and wherein said signal providing means is connected to operate in series with said first, second and third switches.

8. The circuit of claim 7 wherein said first switch is normally open, said first switch being closed when said resistance heater is activated; wherein said second switch is normally closed when said outdoor temperature is above said threshold; and wherein said third switch is normally closed when said reversing valve is in said heat mode position.

9. The circuit of claim 8 wherein said signal provided by said signal providing means is a visual light signal, said light being lit when said first, second and third switches are all closed.

* * * * *

UNITED STATES PATENT OFFICE

CERTIFICATE OF CORRECTION

Patent No. 4,262,736 Dated April 21, 1981

Inventor(s) Robert F. Gilkeson & George C. Wiedersum

It is certified that error appears in the above-identified patent and that said Letters Patent are hereby corrected as shown below:

Column 3, line 27 "operation" should read "operating"

Column 6, line 12 "including" should read "indicating"

Signed and Sealed this

*Eighteenth* Day of *August 1981*

[SEAL]

*Attest:*

GERALD J. MOSSINGHOFF

*Attesting Officer* *Commissioner of Patents and Trademarks*